US009030124B2

(12) United States Patent
Schoel et al.

(10) Patent No.: US 9,030,124 B2
(45) Date of Patent: May 12, 2015

(54) LIGHTING SYSTEM AND METHOD FOR PWM DUTY CYCLE CONTROL

(71) Applicant: North American Lighting, Inc., Farmington Hills, MI (US)

(72) Inventors: Kenneth Wayne Schoel, Shelby Township, MI (US); Daniel Robert Edwards, Ypsilanti, MI (US); Manuel Saldana de Leon, Farmington Hills, MI (US)

(73) Assignee: North American Lighting, Inc., Farmington Hills, MI (US)

( * ) Notice: Subject to any disclaimer, the term of this patent is extended or adjusted under 35 U.S.C. 154(b) by 0 days.

(21) Appl. No.: 13/753,990

(22) Filed: Jan. 30, 2013

(65) Prior Publication Data

US 2014/0210374 A1 Jul. 31, 2014

(51) Int. Cl.
*H05B 33/08* (2006.01)

(52) U.S. Cl.
CPC ..... *H05B 33/0851* (2013.01)

(58) Field of Classification Search
USPC ..... 315/247, 185 S, 291–326, 224, 225
See application file for complete search history.

(56) References Cited

U.S. PATENT DOCUMENTS

| | | | | |
|---|---|---|---|---|
| 6,586,890 | B2 | 7/2003 | Min et al. | |
| 7,528,551 | B2 | 5/2009 | Ball | |
| 7,932,679 | B2 | 4/2011 | Ball | |
| 8,120,273 | B2 | 2/2012 | Edwards | |
| 8,294,375 | B2 * | 10/2012 | Lee | 315/186 |
| 8,536,790 | B2 * | 9/2013 | Inoue et al. | 315/82 |
| 8,569,976 | B2 * | 10/2013 | Shteynberg et al. | 315/307 |
| 8,629,629 | B2 * | 1/2014 | Hariharan | 315/297 |
| 2012/0049753 | A1 * | 3/2012 | Hwang et al. | 315/224 |

* cited by examiner

*Primary Examiner* — Tuyet Vo
(74) *Attorney, Agent, or Firm* — Brooks Kushman, P.C.

(57) ABSTRACT

A lighting system and method are provided for controlling a PWM duty cycle. The lighting system is provided with at least one device that is configured to emit light in response to receiving electrical power. The lighting system includes a power circuit and a feedback circuit. The power circuit is configured to selectively supply power to the device at a duty cycle corresponding to a first mode and a second mode, wherein the duty cycle of the first mode is less than 10% of the duty cycle of the second mode. The feedback circuit is configured to provide a feedback signal that is indicative of the energy provided to the device. The power circuit is further configured to disable power to the device during the first mode in response to the energy being greater than a threshold energy value, thereby adjusting the duty cycle.

13 Claims, 3 Drawing Sheets

LIGHTING SYSTEM AND METHOD FOR PWM DUTY CYCLE CONTROL

TECHNICAL FIELD

One or more embodiments relate to a lighting system and method for controlling a duty cycle of the lighting system.

BACKGROUND

Automotive vehicles have lighting systems for the rear of the vehicle that include lamps that function as tail lights and/or brake lights. Tail lamps produce red light, and are typically wired such that they illuminate whenever the vehicle's front lights are illuminated. Brake lamps are wired such that they illuminate when a driver depresses the brake pedal. The tail lamps may be combined with the brake lamps, or separate from them. When combined, the lamps produce brighter red light for the brake light function, and dimmer red light for the tail light function. The tail and brake light functions may be produced separately or by a dual-intensity lamp.

Creating a brake light and a tail light function for Light Emitting Diode (LED) automotive tail lamps that use the same LEDs for a tail mode and a brake mode requires that the LEDs be driven "ON" to a lesser degree for the tail mode than for the brake mode. The partially "ON" tail mode can be achieved by principles of Pulse Width Modulation (PWM), wherein the LEDs are "ON" for less than 10% of the time. The PWM timing can be implemented by pulsing the LED driver ON/OFF in an open loop fashion from a timing source. Unfortunately, when the LED driver is a switchmode power supply (SMPS), there can be variability in the time it takes to start-up and shut-down the power supply, especially if the SMPS has soft start or is commanded from its soft start control circuits. The variation in the start-up/shut-down time of the power supply impacts the duty cycle performance of a resultant PWM waveform. Specifically, SMPS circuits take time to start-up and shut-down. The start-up and shut-down time changes in response to external conditions such as ambient temperature, input voltage, and load.

A constant PWM duty cycle of an output of the power supply is desirable for combination tail mode and brake mode LEDs. Open loop PWM of the power supply circuits from a soft-start control input allows the duty cycle to drift due to varying start-up and shut-down delay times in the power circuits. A drifting duty cycle causes a drifting perception and measurement of the brightness of the tail mode LEDs.

U.S. Pat. No. 8,120,273 to Edwards discloses a light control system and method for controlling a PWM duty cycle of the light control system.

SUMMARY

A lighting system is provided with at least one device that is configured to emit light in response to receiving electrical power. The lighting system includes a power circuit and a feedback circuit. The power circuit is configured to selectively supply power to the device at a duty cycle corresponding to a first mode and a second mode, wherein the duty cycle of the first mode is less than 10% of the duty cycle of the second mode. The feedback circuit is configured to provide a feedback signal that is indicative of the energy provided to the device. The power circuit is further configured to disable power to the device during the first mode when the energy is greater than a threshold energy value, thereby adjusting the duty cycle.

An apparatus is provided for controlling power provided to at least one light emitting diode (LED). The apparatus includes a power circuit that is connectable to the LED for providing power thereto. The apparatus also includes an integrator circuit and a limit detection circuit. The integrator circuit is configured to receive a current signal that is indicative of a current provided to the LED and to provide an energy signal that is indicative of energy provided to the LED based on the current. The limit detection circuit is operably coupled to the power circuit and the integrator circuit and is configured to provide a reset signal in response to the energy provided to the LED exceeding a predetermined threshold. The power circuit is further configured to disable power to the LED in response to the reset signal.

A method is provided for controlling a pulse width modulation (PWM) duty cycle of power provided to at least one light emitting diode (LED). Power is supplied to the LED, and a current signal is received that is indicative of current provided to the LED. An energy signal is provided that is indicative of energy provided to the LED based on the current signal. Power to the LED is disabled in response to the energy signal exceeding a predetermined threshold.

As such, the lighting system provides advantages over existing systems by adjusting the PWM duty cycle of the power provided to the LED(s) based on the amount of electrical energy provided to the LEDs. The lighting system creates a stable PWM with a switch mode power supply (SMPS) power circuit. The lighting system adapts to a turn-on delay of an unknown duration that is associated with an SMPS, by keeping the energy delivered to the LEDs constant. Further, the lighting system maintains a constant frequency of the PWM signal using an astable oscillator as a timing circuit.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The embodiments of the present disclosure generally provide for a plurality of circuits or other electrical devices. All references to the circuits and other electrical devices and the functionality provided by each, are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microprocessors, integrated circuits, memory devices (e.g., FLASH, RAM, ROM, EPROM, EEPROM, or other suitable variants thereof) and software which co-act with one another to perform any number of the operation(s) as disclosed herein.

Figure 1:
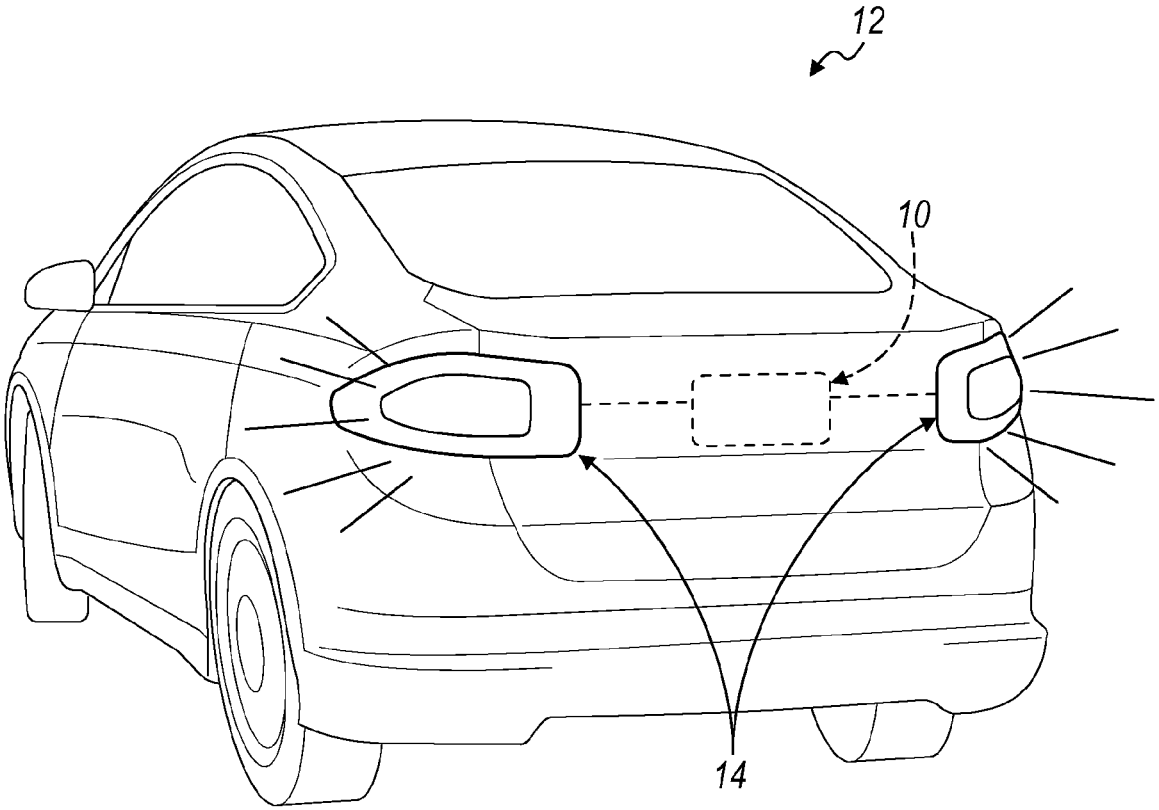
FIG. 1 is a rear perspective view of a vehicle having a lighting system according to one or more embodiments.

With reference to FIG. 1, a lighting system is illustrated in accordance with one or more embodiments, and is generally illustrated by numeral 10. The lighting system 10 is contained within a vehicle 12 and includes light emitting devices that are disposed within tail lamp assemblies 14. In one or more embodiments, the lighting system 10 is fully contained within the tail lamp assemblies 14. The illustrated embodiment depicts two lamp assemblies 14 that are mounted to a rear portion of the vehicle 12. The lighting system 10 controls the light emitting devices (shown in FIG. 2) to operate as both tail lights and brake lights by modulating the amount of electrical power provided to the devices using principles of PWM. Although described with reference to rear lighting functionality, other embodiments of the lighting system 10 contemplate the control of other vehicle exterior lighting applications, such as front lighting with daytime running lights and park lighting functionality.

Figure 2:
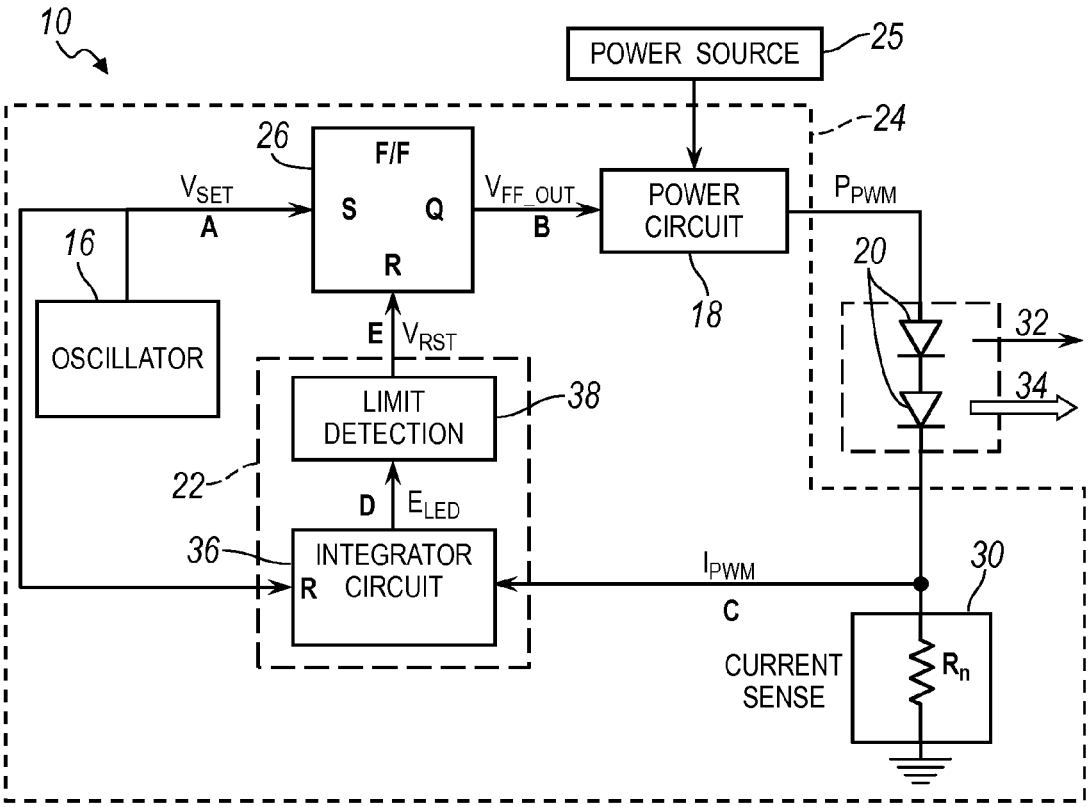
FIG. 2 is a schematic diagram of the lighting system of FIG. 1.

Referring to FIG. 2, the lighting system 10 includes an oscillator 16, a power circuit 18, at least one light emitting device 20 and a feedback circuit 22. The at least one light emitting device 20 includes two light emitting diodes (LEDs) 20, according to the illustrated embodiment. In other embodiments, the lighting system 10 includes one or more than two LEDs 20. The oscillator 16 is a timing circuit that produces a square wave electronic signal, or pulse, ($V_{SET}$) at a constant PWM frequency. The PWM frequency corresponds to the operation of the LEDs 20 in tail light mode. A high PWM frequency is selected (e.g., between 150 Hz and 1 KHz) such that the blinking of the LEDs 20 is generally not perceptible to the unaided human eye. The oscillator 16 may be any type of timing circuit that is configured to produce a pulse at a constant frequency. For example, in one embodiment, the oscillator 16 is a 555 timer integrated circuit (IC) operating in an astable, or free running mode.

In one or more embodiments, the lighting system 10 includes a LED driver module (LDM) 24. The LDM 24 includes a circuit board, and one or more of the lighting system components are mounted to the circuit board. The LDM 24 may be mounted within the tail lamp assembly 14 of FIG. 1. In one embodiment the LDM 24 includes all of the components of the lighting system 10, where the LEDs 20 are mounted to the board. In the illustrated embodiment, the LEDs 20 are mounted in proximity to the board (LDM 24). The LDM 24 is generally referenced as an apparatus herein.

The power circuit 18 is connected to a power source 25 and selectively provides electrical power ($P_{PWM}$) to the LEDs 20. The light emitting devices 20 function as both brake lights and tail lights. The power circuit 18 acts as a LED driver and the LEDS 20 are driven "ON" to a lesser degree for the tail mode than for the brake mode using PWM. To achieve the desired lesser degree, the LEDs are pulsed "ON" using PWM for less than 10% of the time at a repeating rate set by the oscillator 16 during the tail mode. The power circuit 18 is a switch mode power supply (SMPS), according to one or more embodiments. With a SMPS, there can be variability in the time it takes to start-up and shut-down the power supply, especially if the SMPS has soft start or is commanded from its soft start control circuits. The variation in the start-up/shut-down time of the power supply impacts the duty cycle performance of a resultant PWM waveform. Specifically, SMPS circuits take time to start-up and shut-down. The start-up and shut-down time changes in response to external conditions such as ambient temperature, input voltage, load, tolerances and aging. The start-up delay is not precisely predictable and changes over time. Additionally, the start-up delay affects the turn ON characteristics of the power circuit. Generally, the SMPS turns OFF quickly and is of a lesser concern. The start-up delay can take up a significant amount of time when compared to the ON pulse time. Thus, the lighting system 10 adapts to the unknown turn-on delay by keeping the PWM constant with respect to the energy delivered to the LEDs.

A flip-flop 26 is interconnected between the oscillator 16 and the power circuit 18. The flip-flop 26 is configured as an active on, set-reset (SR) flip-flop according to the illustrated embodiment. The flip-flop 26 receives the oscillator pulse ($V_{SET}$) as a set input ("S"), and a feedback signal ($V_{RST}$) from the feedback circuit 22 as a reset input ("R"). The flip-flop 26 generates an output ($V_{FF_OUT}$) based on the input signals ($V_{SET}$, $V_{RST}$).

The flip-flop output ($V_{FF_OUT}$) toggles between "ON" or high, and "OFF" or low, to control the output power provided to the LEDs 20. Generally, while the $V_{SET}$ and $V_{RST}$ inputs are both low, the flip-flop 26 maintains $V_{FF_OUT}$ in a constant state. If $V_{SET}$ is pulsed high while $V_{RST}$ is held low, then $V_{FF_OUT}$ is forced high, and stays high when $V_{SET}$ returns to low; similarly, if $V_{RST}$ is pulsed high while $V_{SET}$ is held low, then $V_{FF_OUT}$ is forced low, and stays low when $V_{RST}$ returns to low.

The lighting system 10 also includes a current sense component 30 for detecting the amount of current provided to the LEDs 20. The current sense component 30 includes one or more resistors ($R_n$) arranged in parallel with the feedback circuit 22. The voltage drop across Rn is proportional to the current flowing through the LEDs 20 and equal to the voltage provided to the feedback circuit 22. Therefore, the current sense component 30 generates an output signal ($I_{PWM}$) that is indicative of the current flowing through the LEDs 20.

The lighting system 10 controls the LEDs 20 to operate as both tail lights and brake lights by modulating the amount of electrical power provided to the devices using PWM. The partially "ON" tail mode can be achieved by a PWM signal having a duty cycle of approximately 5-10%, which is generally represented by numeral 32. The full "ON" brake mode is achieved by a PWM signal having a duty cycle of approximately 100%, which is generally represented by numeral 34. The lighting system 10 controls the energy provided to the light emitting devices 20 by adjusting the PWM duty cycle, while maintaining a constant PWM frequency. The lighting system 10 adjusts the PWM duty cycle based on the energy provided to the LEDs 20 as determined by the feedback circuit 22.

The feedback circuit 22 includes an integrator circuit 36 and a limit detection circuit 38. The integrator circuit 36 calculates the electrical energy provided to the LEDs 20 based on $I_{PWM}$. The calculated electrical energy is represented by signal $E_{LED}$ in FIG. 2. The integrator circuit 36 includes a passive RC circuit according to one embodiment. In other embodiments, the integrator circuit 36 includes any suitable device that is capable of integrating current over time (e.g., an operational amplifier). The integrator circuit 36 may include components that store energy (e.g., a passive RC circuit) then dissipate the energy when the $P_{PWM}$ is turned off. The integrator circuit 36 may reset naturally by dissipating the energy. In one or more embodiments, the integrator circuit 36 receives $V_{SET}$ from the oscillator 16 and resets (hard reset) when $V_{SET}$ toggles high. The limit detection circuit 38 compares the calculated electrical energy ($E_{LED}$) to a predetermined energy threshold value, and provides the feedback signal ($V_{RST}$) based on the comparison. The limit detection circuit 38 includes a Schmitt Trigger and reference voltage according to one embodiment. In other embodiments, the limit detection circuit 38 includes a 555 IC.

Figure 3:
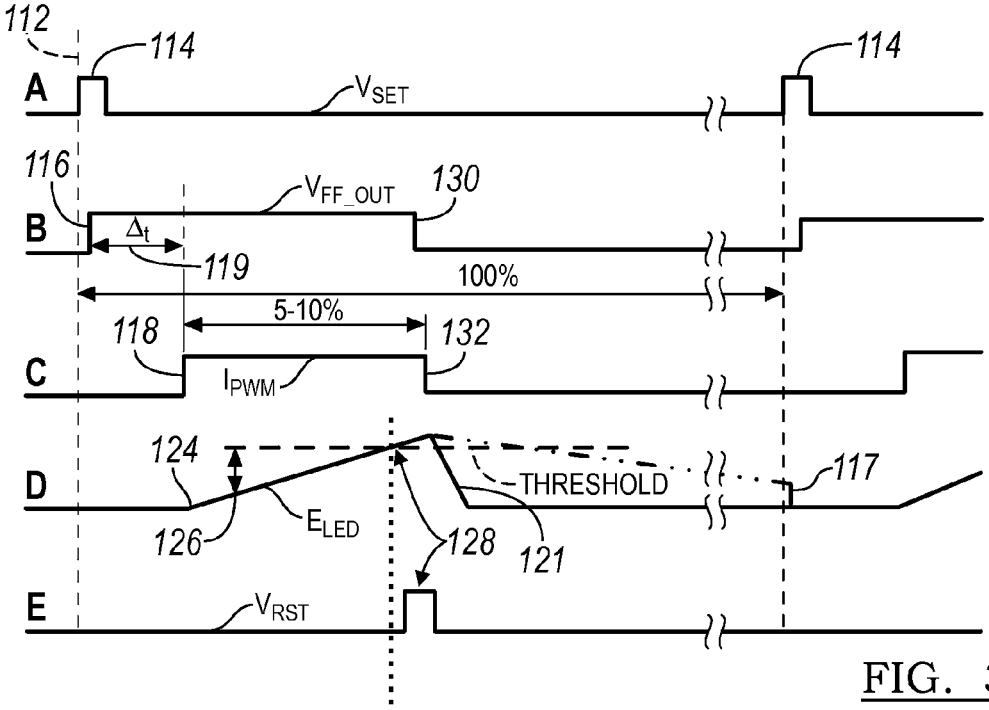
FIG. 3 are plots of electrical values that are detected at various locations of the lighting system of FIG. 2.

FIG. 3 illustrates plots of electrical characteristics over time at various locations A, B, C, D, and E of the lighting system 10 illustrated in FIG. 2. Waveform A represents a voltage measurement of the oscillator pulse ($V_{SET}$) that is provided as an input to the flip-flop 26. Waveform B represents a voltage measurement of the flip-flop output ($V_{FF\text{-}OUT}$) which is "set" by the oscillator pulse $V_{SET}$. Waveform C represents a current measurement ($I_{PWM}$) of the electrical power provided to the LEDs 20. Waveform D represents a calculation of the electrical energy ($E_{LED}$) provided to the LEDs 20. Waveform E represents a voltage measurement of the feedback signal ($V_{RST}$) that is provided as an input to the flip-flop 26. The lighting system 10 is configured as an active high system, according to the illustrated embodiment. However, in other embodiments, the lighting system 10 may be configured as active low, or as a combination of active high and active low.

Figure 4:
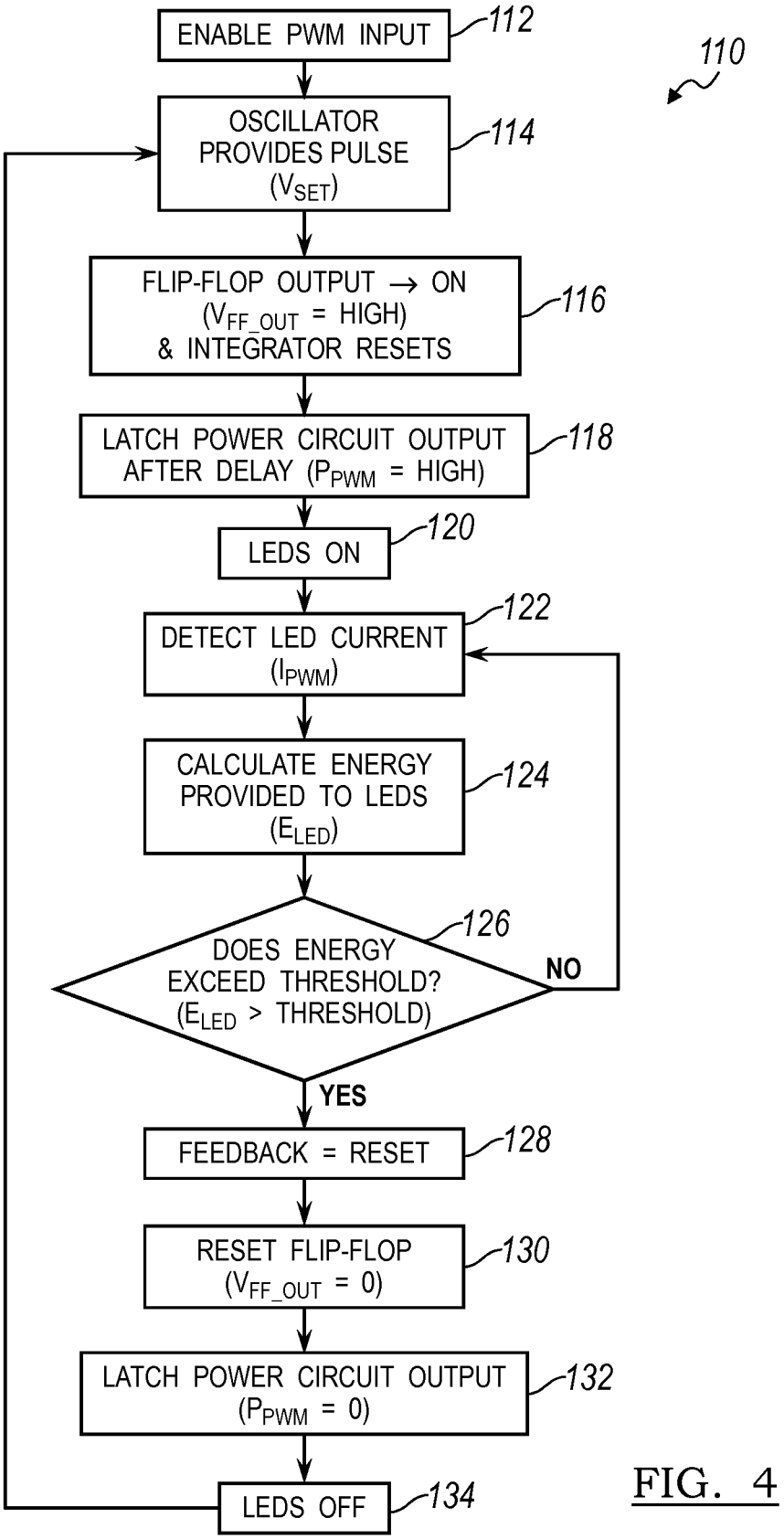
FIG. 4 is a flow chart illustrating a method for controlling a duty cycle of the lighting system of FIG. 1.

With reference to FIGS. 2-4, a method for controlling a PWM duty cycle of the lighting system 10 is illustrated in accordance with one or more embodiments and is generally referenced by numeral 110. The method 110 adjusts the PWM duty cycle to provide generally constant energy on a cycle by cycle basis which is perceived as a constant light output from the LEDs 20, while maintaining a constant PWM frequency.

At operation 112 the lighting system 10 enables PWM input by energizing the oscillator 16, the flip-flop 26 and the power circuit 18. The oscillator 16 generates the oscillator pulse ($V_{SET}$) at operation 114.

At operation 116 the flip-flip 26 output ($V_{FF_OUT}$) toggles ON based on the oscillator pulse ($V_{SET}$), which initiates the PWM cycle. In one or more embodiments, the integrator circuit 36 resets (hard reset) when $V_{SET}$ toggles high. Such a hard reset is depicted by a portion of $E_{LED}$ which is drawn in phantom line, and represented by numeral 117 in FIG. 3. At operation 118 the power circuit 18 provides electrical power after a time delay 119 of an unknown duration. The time delay 119 is associated with the start-up of the SMPS power circuit 18, and is due to various factors (e.g., temperature, load, and system voltage). At operation 120 the LEDs 20 receive $P_{PWM}$ and emit light. In one embodiment, the integrator circuit 36 resets naturally by dissipating the energy, as represented by numeral 121.

At operation 122 the current sense component 30 provides output ($I_{PWM}$) that is indicative of the LED current. At operation 124 the integrator circuit 36 begins calculating the energy ($E_{LED}$) provided to the LEDs 20 based on $I_{PWM}$.

At operation 126 the limit detection circuit 38 compares $E_{LED}$ to a predetermined energy threshold value to determine if the energy is greater than the threshold value. If the determination at operation 126 is negative, then the method returns to operation 122. Once the determination at operation 126 is positive ($E_{LED}$>Threshold), then the lighting system 10 proceeds to operation 128. By repeating steps 122-126 until $E_{LED}$>Threshold, the lighting system 10 reduces the impact of the start-up time delay 119 of the SMPS power circuit 18.

At operation 128, the limit detection circuit 38 toggles $V_{RST}$ high to indicate that $E_{LED}$ has exceeded the energy threshold value. At operation 130 the flip-flop 26 receives $V_{RST}$, and resets its output, by toggling $V_{FF_OUT}$ to zero, or off.

At operation 132, the power circuit 18 toggles $P_{PWM}$ to zero. The LEDs 20 turn off, or stop emitting light at operation 134. The method 110 returns to operation 114 and receives the next oscillator pulse ($V_{SET}$).

The human eye perceives light based on several photometric qualities including, illuminance. Illuminance is the total luminous flux incident on a surface, per unit area. It is a measure of how much the incident light illuminates the surface, wavelength-weighted by the luminosity function to correlate with human brightness perception, or perceived brightness. Illuminance is measured in lux (lumens/$m^2$). As described above, the PWM signal generated by a SMPS may drift due to various delays. A drifting duty cycle causes a drifting perception and variation in the perceived brightness of the LEDs during tail mode.

The method 110 triggers the PWM signal based on the oscillator pulse ($V_{SET}$). Such an approach corrects start up delay as compared to existing methods that use counters. Further, the lighting system 10 controls the PWM duty cycle based on the energy provided to the LEDs 20. The energy provided to the LEDs 20 relates to the light emitted by the LEDs 20. There is generally a linear relationship between the electrical energy provided to the LEDs and the illuminance of the light emitted by the LEDs. Therefore the lighting system 10 provides LEDs 20 with a generally stable illuminance. Existing systems adjust the PWM duty cycle based on time, using counters. Although the amount of time that power is provided to the LEDs relates the illuminance, it is not an accurate correlation due to environmental conditions.

As such, the lighting system 10 provides advantages over existing systems by adjusting the PWM duty cycle of the power provided to the LEDs based on the amount of electrical energy provided to the LEDs. Further, the lighting system maintains a constant frequency of the PWM signal using an astable oscillator as a timing circuit.

Additionally, current manufacturing processes for LEDs result in batches of LEDs having different output (luminance) capabilities. The LEDs are grouped into different bins based on their predicted illuminance. In one or more embodiments the lighting system 10 may utilize the method 110 to compensate for binning.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A lighting system comprising:

at least one device configured to emit light in response to receiving electrical power;

a power circuit configured to supply power to the device at a duty cycle corresponding to a first mode and a second mode, wherein the duty cycle of the first mode is less than 10% of the duty cycle of the second mode; and a feedback circuit configured to provide a feedback signal indicative of energy provided to the device;

wherein the power circuit is configured to turn off power to the device during the first mode in response to the energy being greater than a threshold energy value, thereby adjusting the duty cycle.

2. The lighting system of claim 1 further comprising:

an oscillator operably coupled to the power circuit for providing a set signal at a constant frequency, and wherein the power circuit is further configured to provide the power to the device using PWM at a frequency corresponding to the constant frequency.

3. The lighting system of claim 1 wherein the power circuit is connected to a power source for receiving electrical power, and configured to provide the power to the device using pulse width modulation (PWM).

4. The lighting system of claim 3 wherein the power circuit is further configured to provide the power at a duty cycle of approximately 5-10%, and wherein the duty cycle is adjusted based on the energy provided to the device.

5. The lighting system of claim 1 wherein the feedback circuit further comprises:

an integrator circuit configured to receive a current signal indicative of current provided to the device and to provide an energy signal indicative of the energy provided to the device based on the current; and a limit detection circuit operably coupled to the power circuit and the integrator circuit and configured to provide the feedback signal in response to the energy provided to the device exceeding a predetermined threshold.

6. The lighting system of claim 5 further comprising:

an oscillator for providing a set signal at a constant frequency; and a flip-flop connected to the oscillator for receiving the set signal, and connected to the limit detection circuit for receiving the feedback signal;

wherein the flip-flop provides an output signal to the power circuit based on the set signal and the feedback signal, and wherein the power circuit enables/turns off power to the device based on the output signal for adjusting a duty cycle associated with the power.

7. The lighting system of claim 6 wherein the integrator circuit is further configured to reset the energy signal in response to the set signal.

8. An apparatus for controlling power provided to at least one light emitting diode (LED), the apparatus comprising:

a power circuit connectable to the LED for providing power thereto;

wherein the power circuit is connected to a power source for receiving electrical power, and configured to provide the power to the LED using pulse width modulation (PWM); and wherein the power circuit is further configured to provide the power at a duty cycle of approximately 5-10%, and wherein the duty cycle is adjusted based on the energy provided to the LED;

an integrator circuit configured to receive a current signal indicative of a current provided to the LED and to provide an energy signal indicative of energy provided to the LED based on the current; and a limit detection circuit operably coupled to the power circuit and the integrator circuit and configured to provide a reset signal in response to the energy provided to the LED exceeding a predetermined threshold;

wherein the power circuit is configured to turn off power to the LED in response to the reset signal.

9. The apparatus of claim 8 further comprising:

an oscillator operably coupled to the power circuit for providing a set signal at a constant frequency, and wherein the power circuit is further configured to provide the power to the LED using PWM at a frequency corresponding to the constant frequency.

10. The apparatus of claim 9 wherein the integrator circuit is further configured to reset the energy signal in response to the set signal.

11. The apparatus of claim 8 further comprising:

an oscillator for providing a set signal at a constant frequency;

a flip-flop connected to the oscillator for receiving the set signal, and connected to the limit detection circuit for receiving the reset signal;

wherein the flip-flop provides an output signal to the power circuit based on the set signal and the reset signal, and wherein the power circuit enables/turns off power to the LED based on the output signal for adjusting a PWM duty cycle associated with the power.

12. The apparatus of claim 11 wherein the flip-flop is further configured to provide an output signal at a first voltage in response to receiving the reset signal;

wherein the power circuit is further configured to turn off power to the LED in response to receiving the output signal at the first voltage.

13. The apparatus of claim 12 wherein the flip-flop is further configured to provide an output signal at a second voltage in response to receiving the set signal, the second voltage being greater than the first voltage;

wherein the power circuit is further configured to enable power to the LED in response to receiving the output signal at the second voltage.

* * * * *